US005307974A

United States Patent [19]

Chitty et al.

[11] Patent Number: 5,307,974

[45] Date of Patent: May 3, 1994

[54] RIVET SETTING TOOL

[75] Inventors: Eymard J. Chitty, Norwalk; David S. Rimkoski, Naugatuck, both of Conn.

[73] Assignee: Emhart Inc., Newark, Del.

[21] Appl. No.: 564,176

[22] Filed: Aug. 8, 1990

[51] Int. Cl.[5] ..... B21J 15/20

[52] U.S. Cl. ..... 227/1; 227/111

[58] Field of Search ..... 227/1, 2, 101, 110, 227/111; 83/615, 639

[56] References Cited

U.S. PATENT DOCUMENTS

| | | | |
|---|---|---|---|
| 3,259,352 | 7/1966 | Olsen . | |
| 3,955,739 | 5/1976 | Markus et al. | 227/1 |
| 4,441,643 | 4/1984 | McCutchen | 227/110 |
| 4,604,930 | 8/1986 | Avila et al. | 83/639.5 X |
| 4,754,643 | 7/1988 | Weeks, Jr. et al. | 227/110 X |

FOREIGN PATENT DOCUMENTS

| | | |
|---|---|---|
| 2213810 | 9/1973 | Fed. Rep. of Germany . |
| 3043149 | 6/1982 | Fed. Rep. of Germany . |
| 165152 | 10/1982 | Japan . |
| 462341 | 4/1937 | United Kingdom . |

*Primary Examiner*—Eugenia Jones

*Attorney, Agent, or Firm*—Edward D. Murphy

[57] ABSTRACT

A rivet tool is mounted on a bracket which can be moved vertically up and down suitable guides. To counterbalance the system an air cylinder supports the bracket and a precision pressure regulator responds very rapidly to continuously maintain a selected pressure in the cylinder. The tool will accordingly be maintained in a perfectly counterbalanced condition continuously.

2 Claims, 1 Drawing Sheet

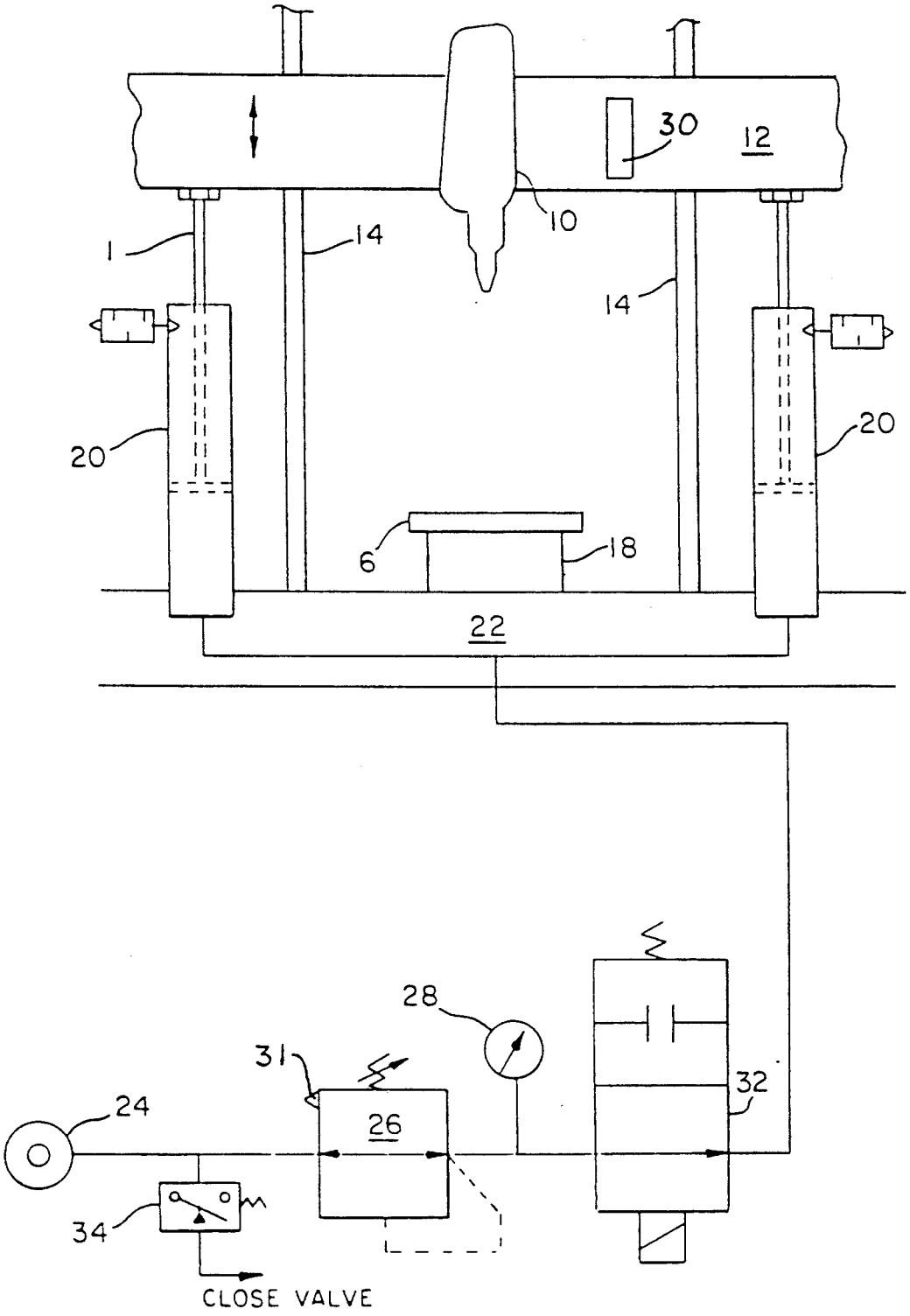
30
12
10
1
14
14
20
20
6
18
22
28
31
32
24
26
34
CLOSE VALVE

RIVET SETTING TOOL

The present invention relates to automatic rivet setting tools which are supported for controlled repetitive displacement.

In high production riveting it is often desirable to repeatedly perform the same riveting operation and to this end a rivet tool can be mounted to be displaceable up and down a vertical guide rod, for example. The easier the tool can be displaced the more productive will be the system.

It is accordingly an object of the present invention to provide a failsafe counterbalanced support for a rivet tool.

Other objects and advantages of the present invention will become apparent from the following portion of the specification and from the accompanying drawings, which illustrate, in accordance with the mandate of the patent statutes, a presently preferred embodiment of the invention.

Referring to the drawings:

The sole figure is a schematic drawing of the automatic rivet setting tool made in accordance with the teachings of the present invention.

An electrically operated rivet setting tool 10 is secured to a support bracket 12 which is vertically displaceable up and down a pair of guide rods 14. The rivet tool can be lowered to perform a riveting operation on a workpiece 6 supported on a workholder 18.

In order to counterbalance the weight of the rivet tool and its support bracket one or two (or more) double acting cylinders 20 are located between the support bracket 12 and the machine base 22 (the workholder 18 is also secured to the machine base). Air under pressure is supplied from a source 24 through a precision pressure regulator 26 to the bottom of the cylinders. The pressure applied can be read from a gauge 28. The precision pressure regulator is adjusted until the combined weight of the rivet tool 10 and support bracket 12 is precisely counterbalanced. The operator raises and lowers the rivet tool with a handle 30 secured to the bracket. When the rivet tool is pulled down, the precision pressure regulator will instantly vent pressure through a suitable vent 31 to continuously maintain the system in a perfectly counterbalanced condition and when the rivet tool is pushed upwardly tending to lower this pressure, the precision pressure regulator will maintain the cylinder pressure at the desired level.

A normally closed two way, spring return solenoid valve 32 is located in the air line between the precision pressure regulator 26 and the air cylinders so that if power is lost, the valve will close locking the position of the support bracket thereby preventing the falling of the rivet tool. Should air pressure fail or drop below an acceptable level a pressure switch 34 will close, sending a signal to a controller to operate the solenoid valve to close the air line locking the position of the cylinders and hence preventing the falling of the rivet tool.

We claim:

1. A rivet setting tool assembly comprising a rivet setting tool, bracket means for supporting said rivet setting tool, and means for supporting said bracket means for counterbalanced vertical movement throughout its displacement between an upper position and a lower position including vertical air cylinder means including a chamber and a displaceable rod connected to said bracket means, precision pressure regulator means connected to said air cylinder means via an air line for continuously maintaining a predetermined pressure in said chamber of said air cylinder means, and a normally closed two way, spring return solenoid valve located in said air line and displaceable from an open position allowing flow through said air line to a closed position closing said air line to prevent the displacement of said bracket means in the event electrical power is lost.

2. A rivet setting tool according to claim 1 further comprising means for turning off electrical power to said solenoid valve in the event air pressure to said regulator means is less than a selected pressure.

* * * * *